US012529369B2

(12) United States Patent
Pavin et al.

(10) Patent No.: US 12,529,369 B2
(45) Date of Patent: Jan. 20, 2026

(54) DIAPHRAGM PUMP

(71) Applicant: PIUSI S.P.A., Suzzara (IT)

(72) Inventors: Francesco Pavin, Grumolo Delle Abbadesse (IT); Giorgio Russo, Vicenza (IT); Alessandro Cazzola, Grumolo Delle Abbadesse (IT)

(73) Assignee: PIUSI S.P.A., Suzzara (IT)

( * ) Notice: Subject to any disclaimer, the term of this patent is extended or adjusted under 35 U.S.C. 154(b) by 0 days.

(21) Appl. No.: 18/809,926

(22) Filed: Aug. 20, 2024

(65) Prior Publication Data

US 2025/0129775 A1 Apr. 24, 2025

(30) Foreign Application Priority Data

Oct. 19, 2023 (IT) ..... 102023000021771

(51) Int. Cl.
*F04B 45/053* (2006.01)

(52) U.S. Cl.
CPC ..... *F04B 45/0536* (2013.01)

(58) Field of Classification Search
CPC .... F04B 39/14; F04B 45/053; F04B 45/0536; F04B 53/22; F04B 43/0009; F04B 53/16
USPC ..... 417/395
See application file for complete search history.

(56) References Cited

U.S. PATENT DOCUMENTS 5,174,731 A * 12/1992 Korver ..... F04B 43/0736 417/393
2015/0004003 A1* 1/2015 Roberts ..... F04B 45/043 417/384
2015/0104336 A1* 4/2015 Elliott ..... F04B 43/0736 417/395

FOREIGN PATENT DOCUMENTS

CA 981 107 A 1/1976
CA 1 172 904 A 8/1984
CN 1517548 A 8/2004
CN 1245573 C 3/2006
CN 210 068 443 U 2/2020
EP 0 304 210 B1 11/1992
EP 0 942 171 A2 9/1999
(Continued)

OTHER PUBLICATIONS

Italian Search Report and Written Opinion dated Jun. 12, 2024 issued in IT 202300025230, with partial translation.
(Continued)

*Primary Examiner* — Mark A Laurenzi
*Assistant Examiner* — Kelsey L Stanek
(74) *Attorney, Agent, or Firm* — Scully, Scott, Murphy & Presser, P.C.

(57) ABSTRACT

A diaphragm pump, which comprises a pump body which defines internally at least one pair of pumping chambers which are connected, at the inlet, to at least one suction connector and, at the outlet, to at least one delivery connector of the pump; pumping chambers are delimited by respective diaphragms, which separate the pumping chambers from actuation chambers, which can be connected, alternately, to a source of compressed air; in the pump body an access opening to the pilot chamber is defined which is closeable by means of a closure element; the closure element comprises a main body made by molding and of plastic material and at least one plate-like element made of a material having, with respect to the sliding pad, a higher resistance to wear and a lower coefficient of friction than the plastic material.

8 Claims, 8 Drawing Sheets

(56) References Cited

FOREIGN PATENT DOCUMENTS

ES 2581203 T3 9/2016

OTHER PUBLICATIONS

European Extended Search Report dated Sep. 12, 2024 received in European Application No. 24 17 5061.1.

* cited by examiner

DIAPHRAGM PUMP

The present invention relates to a diaphragm pump.

Diaphragm pumps are known which have a pump body, inside which at least one pair of pumping chambers is defined, both of which are connected to a suction connector and to a delivery connector of the pump, by means of the interposition of respective check valves.

The pumping chambers are delimited by respective diaphragms which separate the pumping chambers from respective actuation chambers, in which compressed air is cyclically introduced and expelled, so as to generate an alternating movement of the two diaphragms which results in the transfer of the liquid to be pumped from the suction connector to the delivery connector of the pump.

A power valve is provided in order to move the compressed air into and out of the actuation chambers, which cyclically connects one of the two actuation chambers with a source of compressed air and the other actuation chamber with the outside environment.

A working chamber is provided inside the power valve, in which a flow control element of the shuttle type can move with a reciprocating motion and, according to the position assumed, enables the alternating opening and closing of the connection of the actuation chambers respectively with the source of compressed air and with the outside environment.

The actuation of the shuttle-type flow control element in the power valve is controlled by a pilot valve, also called an end-of-travel valve, the function of which is to introduce and expel compressed air into and from a portion of the working chamber of the power valve, so as to produce the reciprocating motion of the shuttle-type flow control element.

In particular, the pilot valve is provided internally with a sliding pad cursor, which is accommodated in a pilot chamber, supplied with compressed air, and which can slide along a wall of the body of the pump, in which a number of ports are defined: a pilot port, which is connected to a portion of the working chamber of the power valve, and a discharge port for the compressed air, which is connected to the outside environment.

More specifically, the sliding pad cursor is pushed by the diaphragms, by way of a connecting rod or shaft, so that the alternating motion of the diaphragms is converted to a reciprocating motion of the pad cursor between two extreme stroke limit positions, in order to allow the compressed air to be sent alternately to the pilot port or to the discharge port, in so doing producing the displacement of the shuttle flow control element in one or the other direction, and therefore the introduction of compressed air into one actuation chamber and the flushing of the other chamber, and vice versa.

In a pilot valve constructed in this way, although it offers excellent reliability, the sliding pad will exhibit wear over time.

In pumps according to the prior art, if an operation needs to be carried out on the pilot valve, it is necessary to disassemble the pump almost completely, with evident inconvenience in terms of both time and labor, as well as cost.

In order to overcome this drawback, a diaphragm pump has been offered on the market which is provided with a pilot valve that has a sliding pad that can easily be accessed from outside the pump.

In particular, in this case, in an easily accessible area of the pump body, an access opening is defined which, under normal operating conditions of the pump, is closed by a removable closure element.

Once the closure element is removed, this access opening connects the outside environment with the part of the pump affected by the presence of the sliding pad, i.e. the working chamber of the pilot valve, so as to enable the user to easily reach the sliding pad and replace it.

At present, the closure element of the access opening to the pilot valve is a metallic body, in particular a body made of stainless steel, which has a portion that can be inserted in the access opening, which is made from a solid block by turning using machine tools and which is fitted with adapted gasket seals, as well as a flanged fixing head, designed to be fixed by means of screws to the body of the pump and which is made by laser cutting or using a machining center.

The pilot port and the discharge port are also created, again using machine tools, in the body of the closure element, on a face thereof that is intended to make contact with the sliding pad, and the corresponding sections of channel are also created on this face and carry the compressed air respectively to the power valve and to the outside environment.

Although this type of pump is a sound implementation solution in practical terms, it has been found that a pump constructed in this manner is rather complex to make and has very high production costs.

Another drawback of the known art is constituted by the fact that at present there is a certain tendency for dust, dirt, liquids or the like to enter the working chamber of the pilot valve through the discharge port, which can cause serious problems in the operation of the pump.

The aim of the present invention is to provide a diaphragm pump which is capable of improving the known art in one or more of the above-mentioned aspects.

Within this aim, an object of the invention is to provide a diaphragm pump that allows convenient access to the inner region of the pilot valve, without requiring the disassembly of the pump, and which, at the same time, can be provided simply and at low cost.

Another object of the invention is to provide a diaphragm pump that enables an optimal and rational use of the materials for its production.

Another object of the invention is to provide a diaphragm pump that is capable of preventing the possible entry of dust or dirt inside the pilot valve through its discharge port.

A further object of the present invention is to overcome the drawbacks of the known art in an alternative manner to any existing solutions.

Another object of the invention is to provide a diaphragm pump that offers high reliability and safety in its operation.

This aim and these and other objects which will become better apparent hereinafter are achieved by a diaphragm pump according to claim 1, optionally provided with one or more of the characteristics of the dependent claims.

Further characteristics and advantages of the invention will become better apparent from the detailed description that follows of a preferred, but not exclusive, embodiment of the diaphragm pump according to the invention, which is illustrated for the purposes of non-limiting example in the accompanying drawings wherein.

Figure 1:
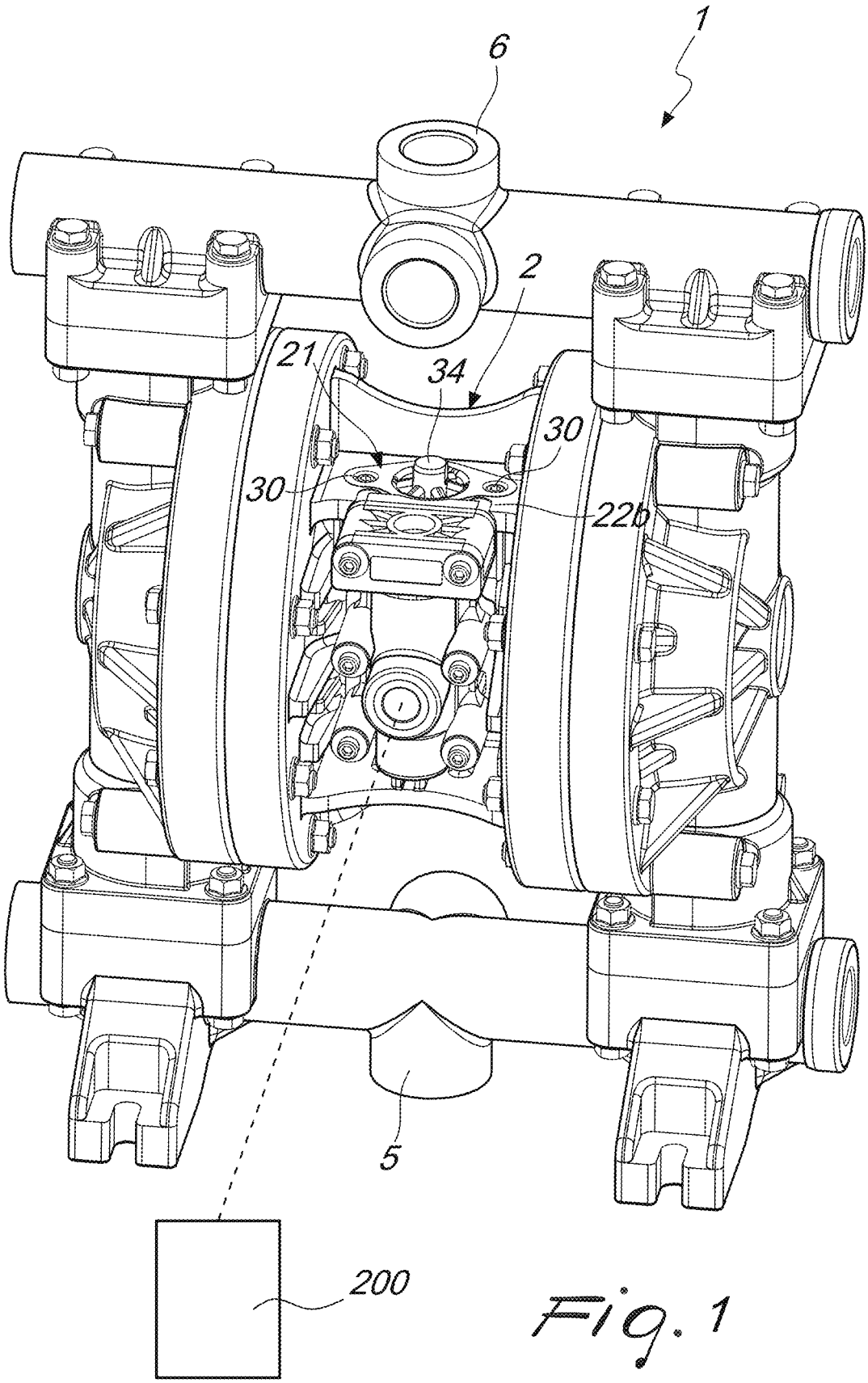
FIG. 1 is a perspective view of a diaphragm pump according to the invention.
Figure 2:
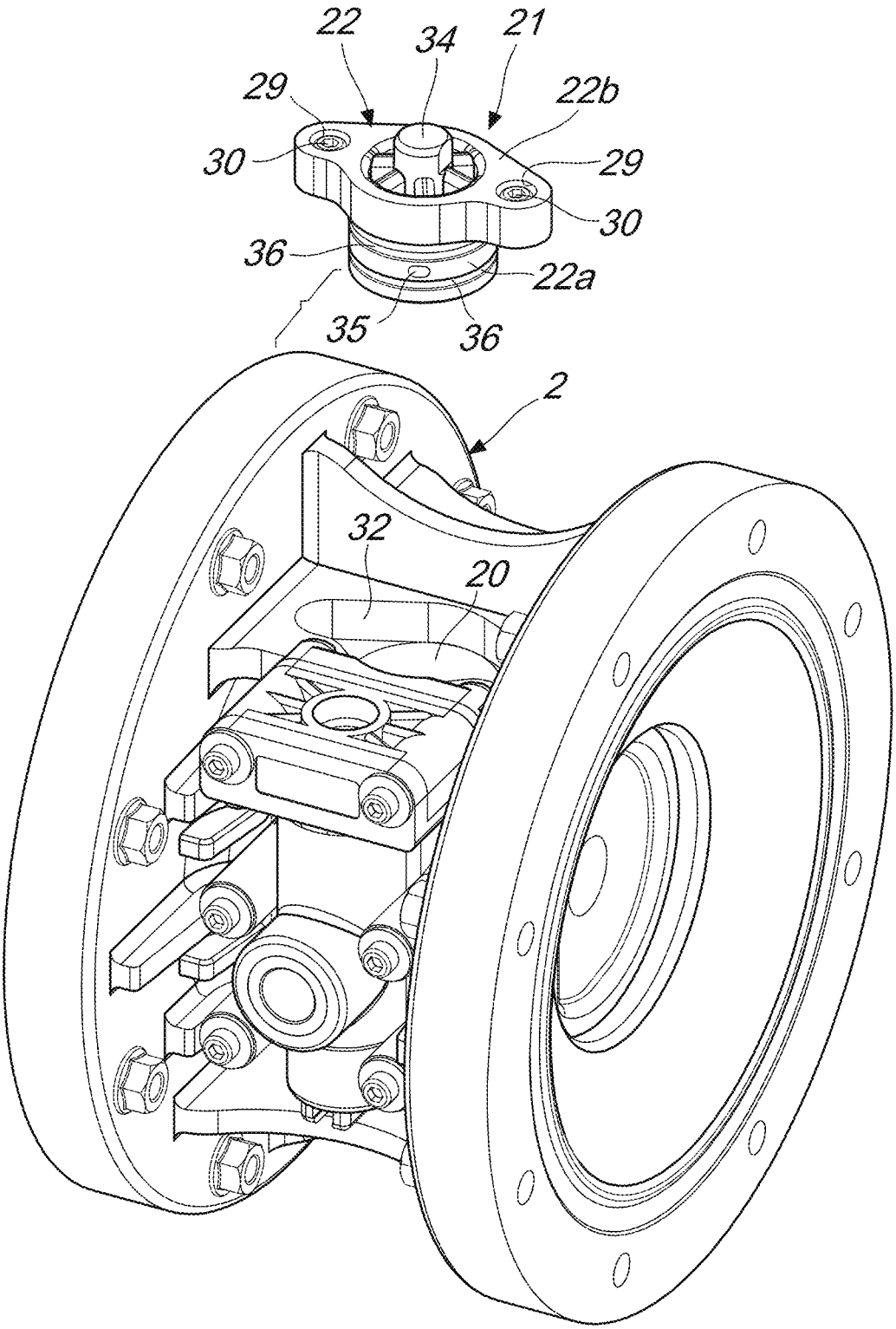
FIG. 2 is an exploded perspective view of the pump according to the invention, with parts omitted for the sake of simplicity.
Figure 3:
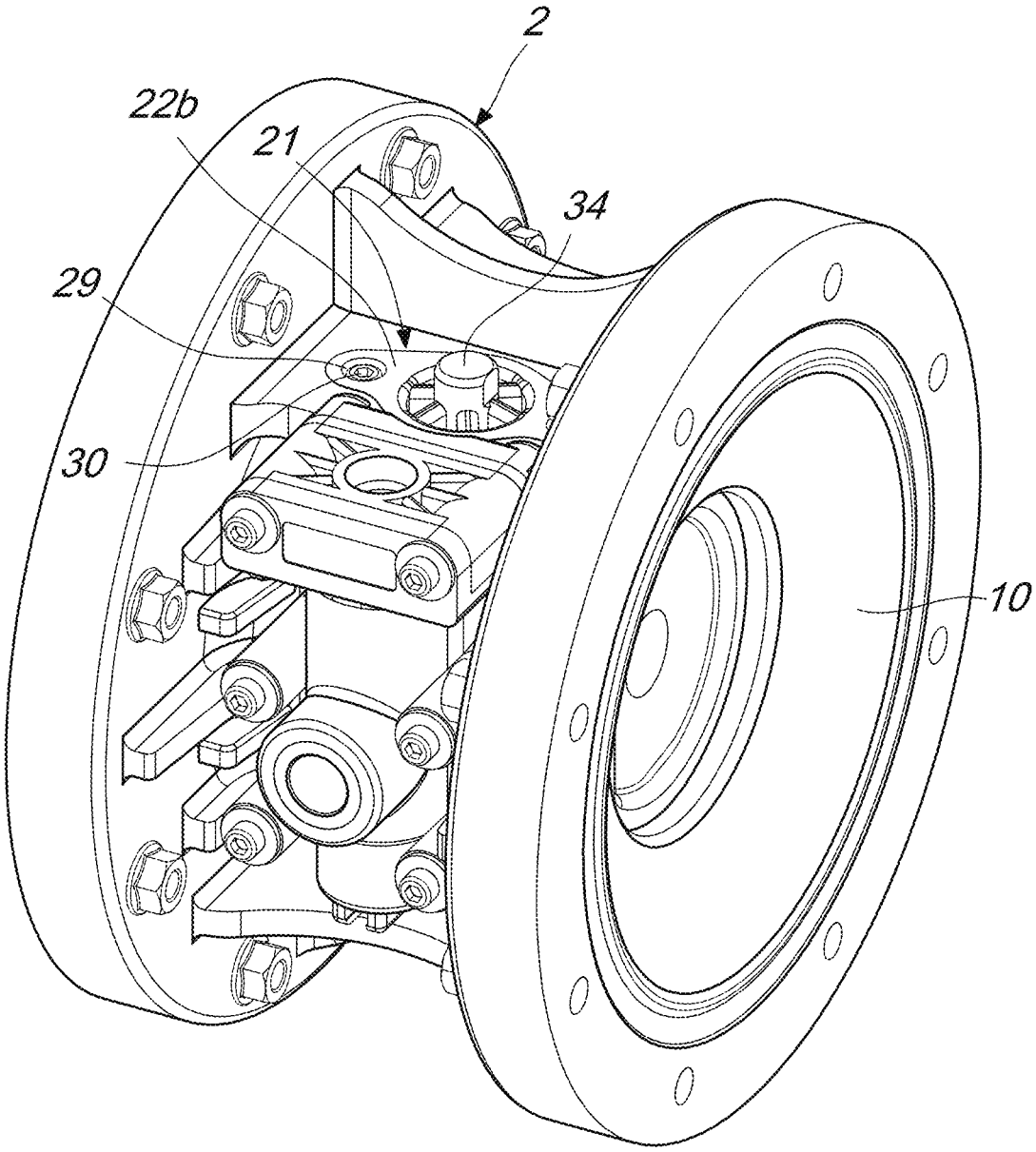
FIG. 3 is a perspective view of the part of the pump of FIG. 2.
Figure 4:
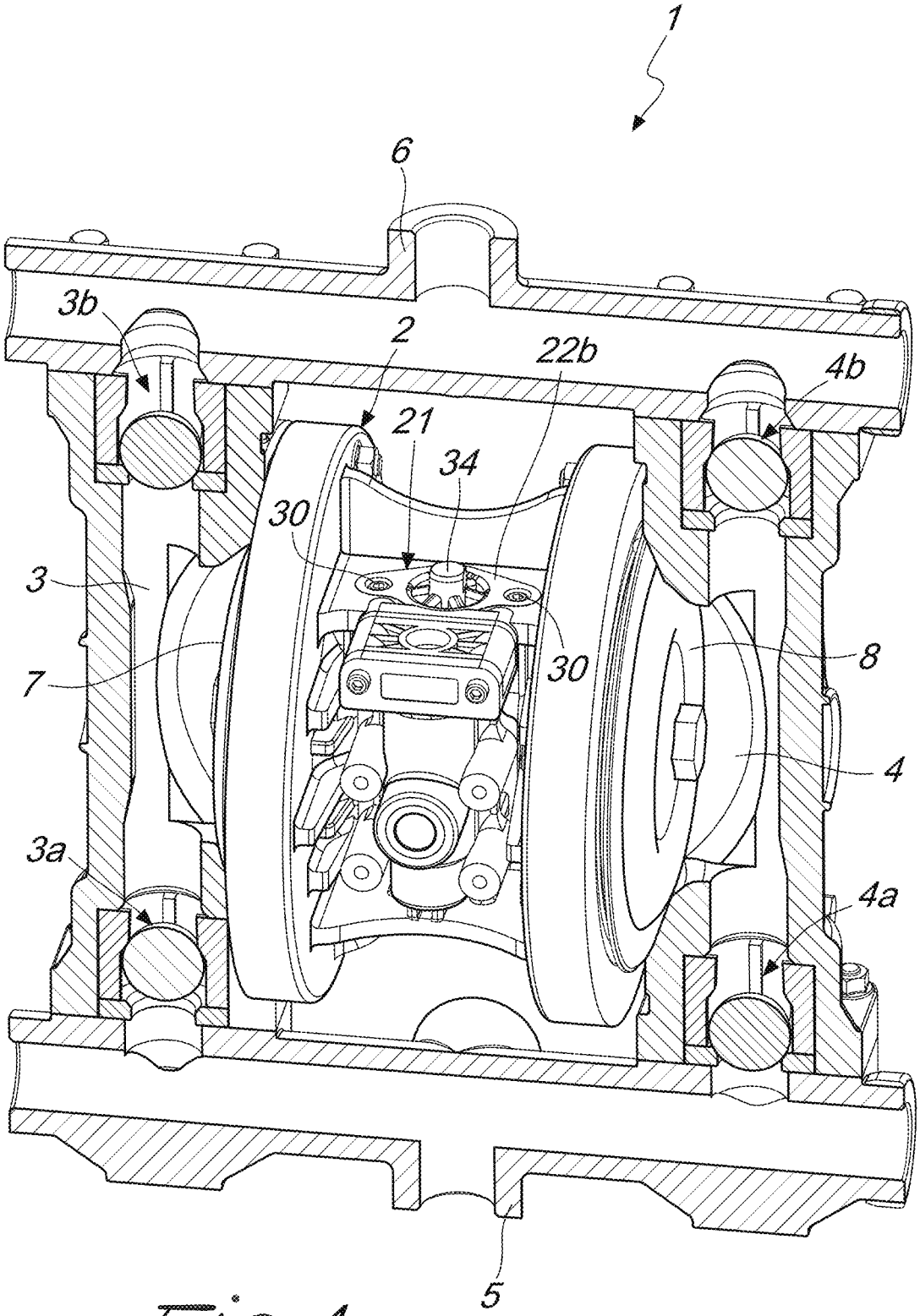
FIG. 4 is a perspective view of the pump according to the invention, partially cutaway to show the interior thereof.
Figure 5:
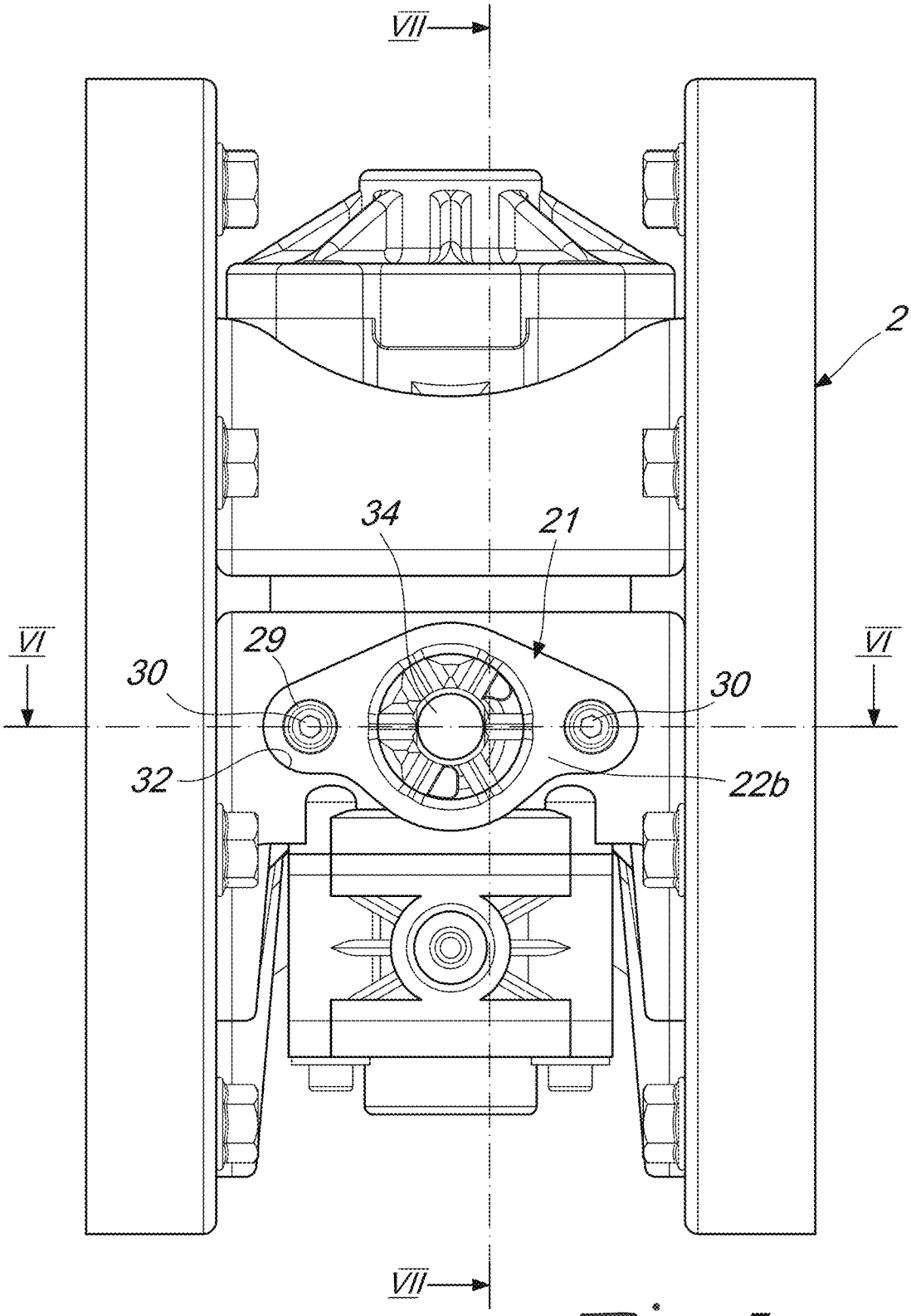
FIG. 5 is a plan view from above of a portion of the pump according to the invention.
Figure 6:
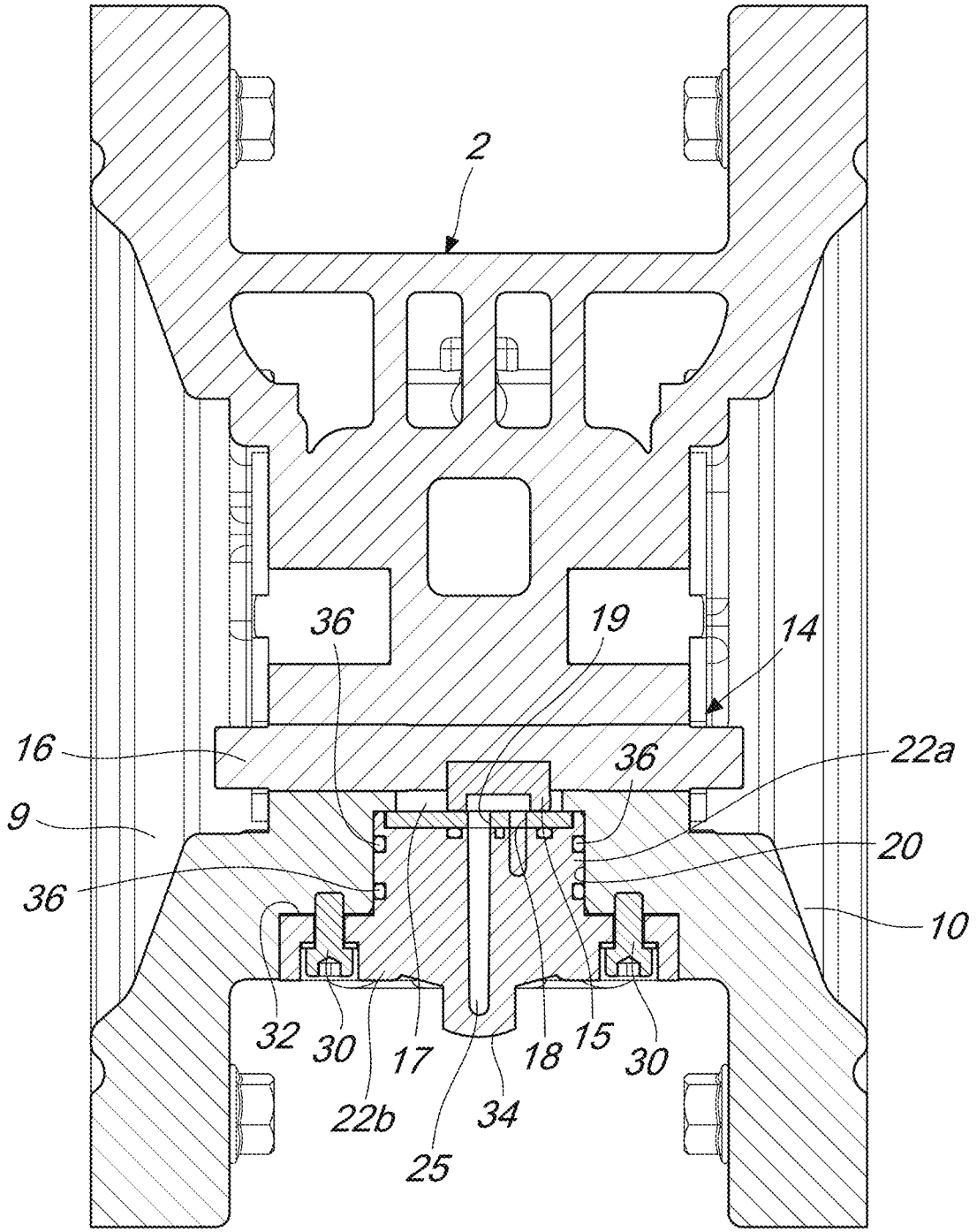
FIG. 6 is a cross-sectional view taken along the line VI-VI in FIG. 5.
Figure 7:
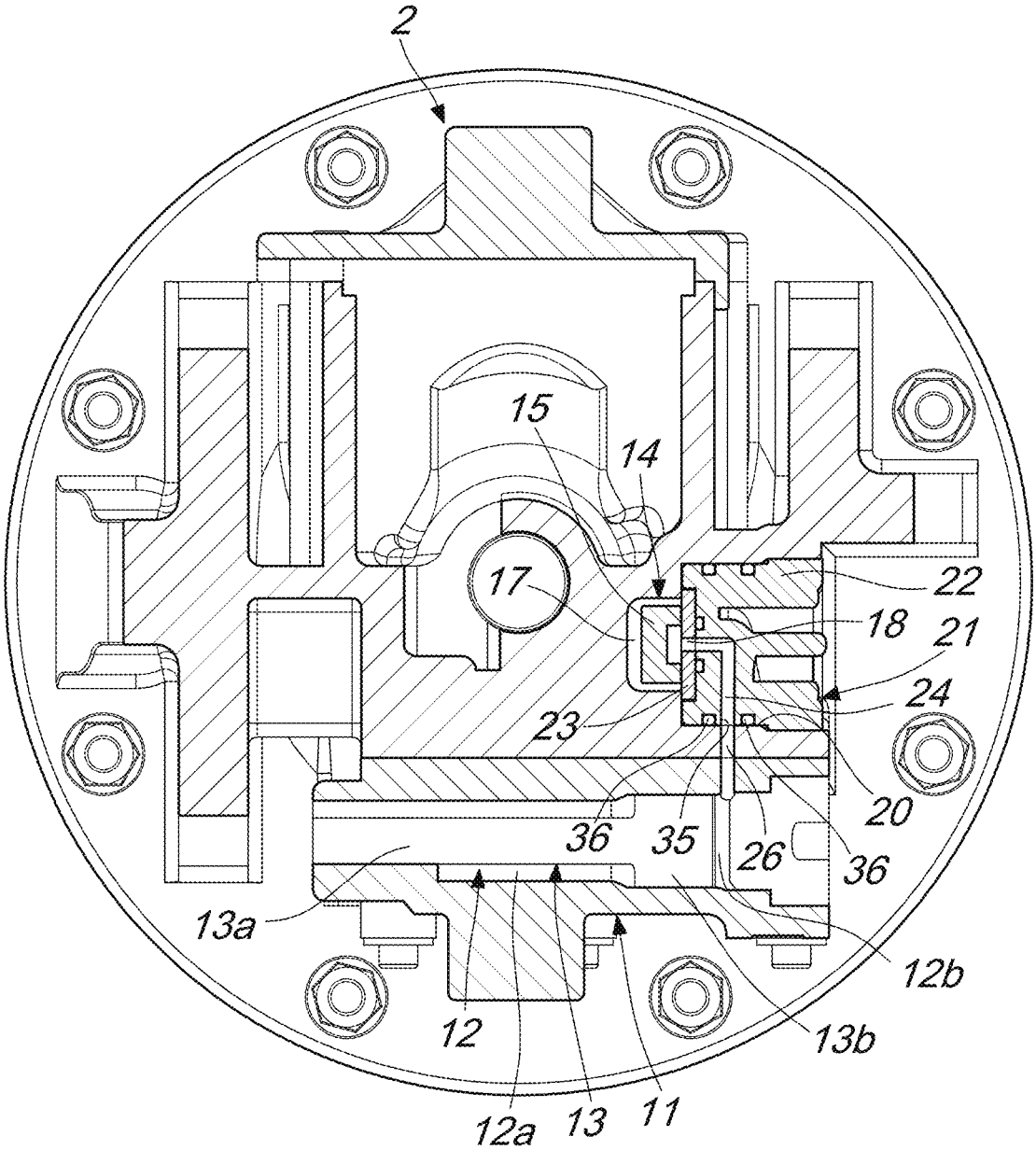
FIG. 7 is a cross-sectional view taken along the line VII-VII of FIG. 5.
Figure 9:
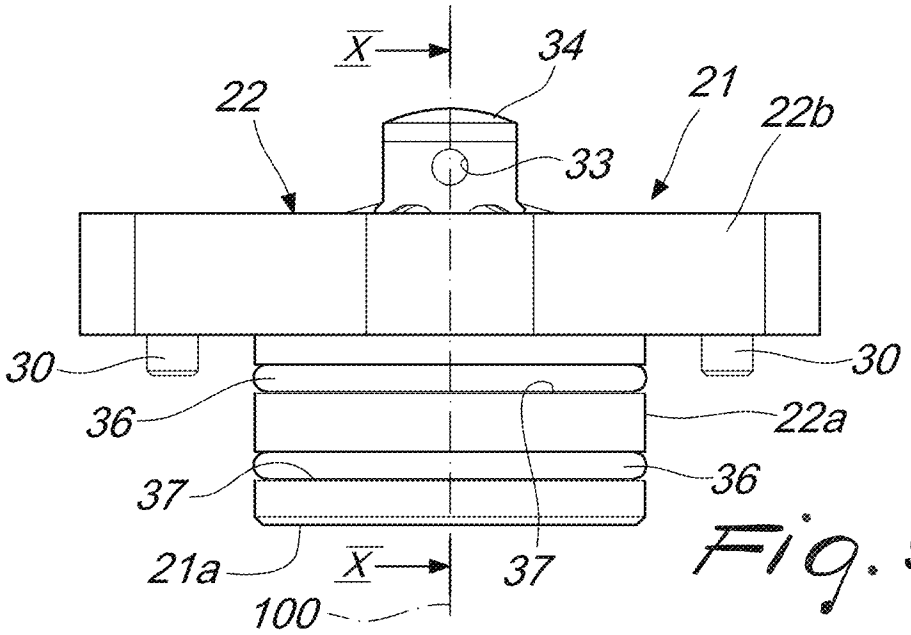
FIG. 9 is a side view of the closure element.
Figure 10:
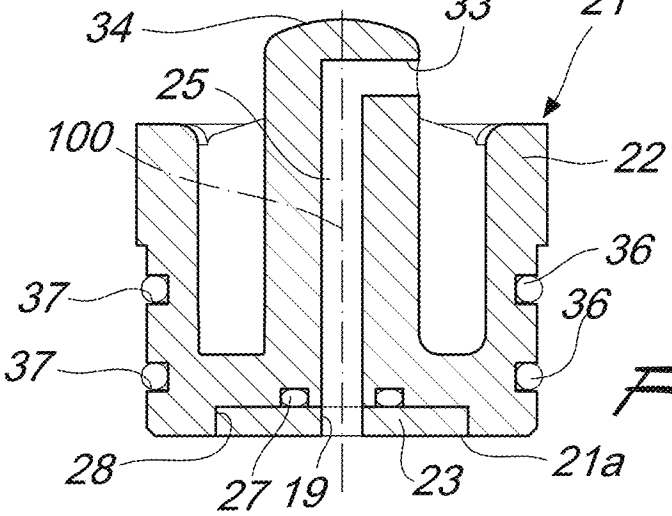
FIG. 10 is a cross-sectional view taken along the line X-X of FIG. 9 of the closure element.
Figure 8:
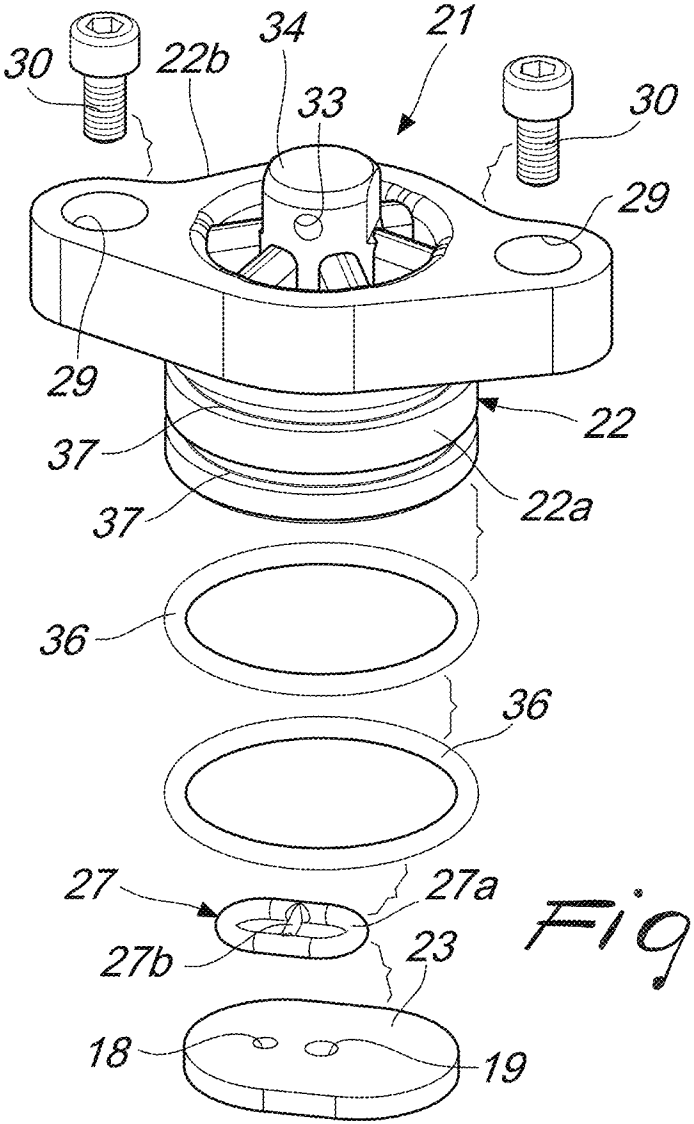
FIG. 8 is an exploded perspective view of a closure element for an access opening to the pilot valve of the pump according to the invention.

With reference to the figures, the diaphragm pump according to the invention, generally designated by the reference numeral 1, comprises a pump body 2, which defines internally at least one pair of pumping chambers 3 and 4, which are connected, at the inlet, to at least one suction connector 5 and, at the outlet, to at least one delivery connector 6 of the pump, by means of the interposition of respective check valves 3*a*, 3*b* and 4*a*, 4*b*.

In particular, the pumping chambers 3 and 4 are delimited by respective diaphragms 7 and 8, which separate the pumping chambers 3 and 4 from respective actuation chambers, more precisely from a first actuation chamber 9 and from a second actuation chamber 10.

More specifically, as is per se known, the actuation chambers 9 and 10 can be alternately connected to a source of compressed air 200, by means of a power valve 11, which is conveniently associated with the pump body 2.

The power valve 11 makes it possible to send, cyclically, the compressed air to one of the two actuation chambers 9, 10, while the compressed air present in the other actuation chamber 9, 10 is discharged into the outside environment, and vice versa, so as to impart a simultaneous to-and-fro movement on the two diaphragms 7 and 8 that makes it possible to vary the volume of the pumping chambers 3 and 4, so as to produce the transfer of the liquid to be pumped from the suction connector 5 to the delivery connector 6.

Conveniently, as per se known, inside the power valve 11 a working chamber 12 is provided, in which a flow control element of the shuttle type 13 can move with a reciprocating motion and, according to the position assumed inside the working chamber 12, enables the alternating opening and closing of the connection of the actuation chambers 9 and 10 respectively with the source of compressed air 200 and with the outside environment.

In particular, the shuttle-type flow control element 13 can move, inside the working chamber 12, between a first operating position, in which the compressed air is sent to the first actuation chamber 9 and expelled from the second actuation chamber 10, and a second operating position, in which the compressed air is sent to the second actuation chamber 10 and expelled from the first actuation chamber 9.

The power valve 11 is controlled by a pilot valve 14, which conveniently is also defined, together with its valve body, in the pump body 2.

The pilot valve 14 makes it possible, in particular, to command the displacement of the shuttle-type flow control element 13 of the power valve 11 from the first operating position to the second operating position and vice versa, by sending compressed air to at least one portion of the working chamber 12 of the power valve 11, as will be explained below.

In detail, as in the example shown, the shuttle-type flow control element 13 of the power valve 11 has a rod portion 13*a*, taking up less lateral space than the working chamber 12, which extends axially in the working chamber 12 and which is connected, at one end, to a plunger portion 13*b*, which slides along the lateral wall of the working chamber 12 and is configured to divide the working chamber 12 into a first portion 12*a*, connected constantly to the source of compressed air 200 and into which the rod portion 13*a* extends, and a second portion 12*b*, connected to the pilot valve 14, which operates so as to connect the second portion 12*b* of the working chamber 12 alternately with the source of compressed air 200 or with the outside environment.

More specifically, the surface of the plunger portion 13*b* directed toward the first working portion 12*a* of the working chamber 12 is smaller than the surface of the plunger portion 13*b* directed toward the second working portion 12*b* of the working chamber 12.

In this manner, when the pilot valve 14 connects the second portion 12*b* of the working chamber 12 with the outside environment, the plunger portion 13*a*, under the thrust exerted by the compressed air present in the first portion 12*a* of the working chamber 12, automatically assumes one of the two operating positions, for example the first operating position.

When the pilot valve 14 connects, instead, the second portion 12*b* of the working chamber 12 with the source of compressed air 200, the thrust exerted on the plunger portion 13*b* by the compressed air present in the second portion 12*b* of the working chamber 12 causes the displacement of the shuttle-type flow control element 13 toward the other operating position i.e. toward the second operating position, because this thrust is greater than the thrust exerted on the plunger portion 13*b* by the compressed air present in the first portion 12*a* of the working chamber 12, because of the larger surface of the plunger portion 13*b* directed toward the second portion 12*b* of the working chamber 12 compared to the surface of the same plunger portion 13*b* directed toward the first portion 12*a* of the working chamber 12.

In detail, the pilot valve 14 has a pilot chamber 17, supplied with compressed air, inside which a sliding pad 15 is accommodated which can move with a reciprocating motion, so as to connect, alternately, this pilot chamber 17 with a pilot port 18, connected to the pilot valve 11 and, more specifically, with the second portion 12*b* of the working chamber 12 of the power valve 11, or with a discharge port 19, which is connected with the outside environment.

The sliding pad 15 is mechanically pushed by the diaphragms 7 and 8, conveniently by way of a connecting rod 16, so that its position inside the pilot chamber 17 is determined by the position of the diaphragms 7 and 8.

In the pump body 2, furthermore, an access opening 20 is provided which is adapted to allow access from outside to the pilot chamber 17 and to the sliding pad 15, in order to carry out maintenance operations on the pilot valve 14.

Conveniently, such access opening 20 is defined in a region of the pump body that is easily and conveniently accessible to the operator and, in particular, on a flat face defined in the upper part of the pump body 2.

The access opening 20, in normal operating situations of the pump, is closed by a closure element 21, which can be removably fixed to the pump body 2.

This closure element 21 has a contact face 21*a*, which can be inserted in the access opening 20 and which is adapted to come into contact with the sliding pad 15.

In particular, both the pilot port 18 and the discharge port 19 are defined in the contact face 21*a* of the closure element 21.

The closure element 21 comprises a main body 22, which is made by molding and of plastic material, and at least one plate-like element 23, which is coupled to the main body 23 and which defines at least one portion of the contact face 21*a* of the closure element 21 and, more precisely, the portion of the contact face 21*a* that is affected by the sliding pad 15 sliding on it. Such plate-like element 23 is made of a material that has, compared to the sliding pad 15, a greater resistance to wear and a lower friction coefficient with respect to the plastic material of which the main body 22 is made.

For example, the material from which the plate-like element 23 is made can be a metallic material, preferably stainless steel, or a ceramic material.

A plastic material that can be positively used to make the main body 22 can be, for example, polypropylene.

As illustrated, in the plate-like element 23 there are, conveniently, holes which define, respectively, the pilot port 18 and the discharge port 19 of the pilot valve 14.

In particular, such holes are positioned in the plate-like element 23 so as to be in alignment, once the plate-like element 23 is coupled to the main body 22 of the closure element 21, respectively with a pilot channel 24 and with a discharge channel 25, which are defined inside the main body 22 of the closure element 21.

Conveniently, the pilot channel 24, with the closure element 21 positioned in the access opening 20, is connected with a connecting section 26, which is defined in the pump body 2 and which leads into the second portion 12*b* of the working chamber 12 of the power valve 11, while the discharge channel 25 is directly connected to the outside, as will be explained below.

Advantageously, between the main body 22 and the plate-like element 23 of the closure element 21, at least one gasket 27 is interposed, which is configured to ensure the continuity between the hole that defines the pilot port 18 and the pilot channel 24, as well as between the hole that defines the discharge port 19 and the discharge channel 25, in addition to the fluid seal between the pilot channel 24 and the discharge channel 25.

For example, the gasket 27 has an annular portion 27*a* designed to engage a region of the plate-like element 23 and of the main body 22 which extends around the holes that define the pilot port 18 and the discharge port 19, and a central portion 27*b*, which is arranged inside the annular portion 27*a* and connected at its ends to two mutually opposite points of the annular portion 27*a* and which is designed to be interposed between the hole of the pilot port 18 and the hole of the discharge port 19.

Conveniently, an accommodation recess 28 is defined in the main body 22, and is contoured to allow the plate-like element 23 to be placed inside it, so that the plate-like element 23 is positioned, with its face located at the contact face 21*a* of the closure element 21, substantially flush with the portion of the main body of the closure element which in turn is located at the contact face 21*a* of the closure element 21.

Conveniently, the main body 22 of the closure element 21 is provided, along an axis of extension 100 thereof, with a coupling portion 22*a*, which is contoured substantially to correspond to the access opening 20 and can be inserted axially inside it, with one of its ends, at which the contact face 21*a* of the closure element 21 is located.

At the opposite end of the insertion portion 22*a*, the main body 22 is further provided with a fixing head 22*b*, which protrudes laterally with respect to the coupling portion 22*a*, in order to engage a region of the pump body arranged around the access opening 20.

Conveniently, accommodation openings 29 are defined in the fixing head 22*b* for fixing screws 30 which can be screwed into the pump body 2, so as to be able to fix the closure element 21 to the pump body 2.

For example, as in the embodiment shown, the fixing head 22*b* can comprise a pair of lateral protrusions or wings, mutually opposite and protruding radially with respect to the axis of extension 100 of the main body 22, in each one of which a respective accommodation opening 29 is defined for the fixing screws 30.

Advantageously, a recessed region 32 is defined in the pump body 2, at the flat face on which the access opening 20 is located, and is situated around the access opening 20 and is contoured to receive the fixing head 22*b*, so that, with the closure element 21 positioned in the access opening 20, the fixing head 22*b* is recessed in the pump body 2 and with its face directed outward in a position aligned with the flat face of the pump body 2 in which the access opening 20 is defined.

It should be noted that, advantageously, the compressed air discharge channel 25, which is defined inside the main body 22 of the closure element 21, is connected with the outside environment at at least one exit opening 33, which is defined in a portion of the main body 22 that is adapted to be arranged externally to the pump body 2 and is situated in a lateral position with respect to the axis of extension 100 of the main body 22, so as to prevent, or at least considerably limit, the risk of entry of dust or other dirt into the pilot chamber 17 of the pilot valve 14, through the discharge channel 25.

Conveniently, the exit opening 33 can be defined at the lateral surface of an axial protrusion 34, substantially cylindrical in shape, which is integrally defined in the main body 22 of the closure element 21 and which protrudes axially from the face of the fixing head 22*b* that is designed to remain outside the pump body 2, with the closure element 21 positioned in the access opening 20.

Advantageously, as in the example shown, the discharge channel 25 extends, starting from the discharge port 19 toward the exit opening 33, for at least one first section, substantially parallel or, optionally, coaxially to the axis of extension 100 and, for at least one second section, connected to the first section, substantially radially with respect to the first section.

Basically, the discharge channel 25 can conveniently be L-shaped.

In turn, the pilot channel 24 is provided, on the lateral surface of the coupling portion 22*a* of the main body 22 of the closure element 21, with a connection port 35, which, with the closure element 21 positioned in the access opening 20, is consequently positioned in alignment with the connecting section 26, so as to obtain the communication between the pilot port 18 and the second portion 12*b* of the working chamber 12 of the power valve 11.

For completeness, it must be noted that one or more sealing elements 36 are, conveniently, associated with the main body 22 of the closure element 21, and are designed to act between the coupling portion 22*a* of the main body 22 and the side wall of the access opening 20, in order to ensure the seal of the pilot chamber 17, once the closure element 21 is positioned in the access opening 20.

Such sealing elements 36 conveniently comprise sealing rings that extend about the axis of extension 100 and which are, conveniently, accommodated in respective annular grooves 37, defined on the lateral surface of the coupling portion 22*a* of the main body 22 of the closure element 21.

In particular, the sealing elements 36 are arranged along the coupling portion 22*a* so as to be positioned on mutually opposite sides with respect to the connection port 35 of the pilot channel 24, so as to also ensure the seal of the connection between the pilot channel 24 and the connecting section 26.

The use of the diaphragm pump, according to the invention, is the following.

Under normal operating conditions of the pump, the closure element 21 is positioned in the access opening 20, so as to close the connection between the pilot chamber 17 of the pilot valve 14 and the outside environment, and it is fixed to the pump body 2, by way of the fixing screws 30.

In these conditions, the compressed air supplied by the source of compressed air 200 to the first portion 12*a* of the working chamber 12 of the power valve 11 is sent, alternately, according to the position in which the shuttle-type flow control element 13 is, to one or to the other of the two actuation chambers 9 and 10, so as to cause the simultaneous displacement of the diaphragms 7 and 8 and, therefore, the variation of the volume of the corresponding pumping chambers 3 and 4, with the consequent transfer of the liquid to be pumped from the suction connector 5 to the delivery connector 6 of the pump.

The movement of the shuttle-type flow control element 13 from the first operating position to the second operating position 13 is obtained by way of the alternating sending and flushing of compressed air by the second portion 12*b* of the working chamber 12 of the power valve 11, on the basis of the position assumed by the sliding pad 15 inside the pilot chamber 17 of the pilot valve 14.

In particular, when the diaphragms 7 and 8 reach one of their stroke limit positions, the sliding pad 15 will be in a position in which either it opens the connection between the pilot port 18 and the first portion 12*a* of the working chamber 12 of the power valve 11 or it opens the connection between the second portion 12*b* of the working chamber 12 of the power valve 11 and the outside environment, so as to produce the displacement of the shuttle-type flow control element 13 from one to the other of its operating positions and in so doing send compressed air to the actuation chamber 9, 10 that was previously flushed, with consequent reversal of the movement of the diaphragms 7 and 8 toward the other stroke limit position thereof, so obtaining another variation of the volume of the respective pumping chambers 3 and 4.

If an intervention is required for maintenance or repair of the pilot valve 14, it is not necessary for the operator to carry out the full disassembly of the pump body 2 and it will be sufficient for the operator to unscrew the fixing screws 30 from the pump body 2 and remove the closure element 21, so as to be able to reach the inside of the pilot valve 14 through the access opening 20 and carry out the required interventions without difficulty.

From the foregoing it can be seen that the invention fully achieves the intended aim and objects by providing a diaphragm pump, in which the closure element of the opening that allows easy access to the inner region of the pilot valve is obtained using techniques and materials that are capable of optimally marrying the requirements of reliability and safety of the component with those of simplicity and economy of construction.

The invention thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102023000021771 from which this application claims priority are incorporated herein by reference.

What is claimed is:

1. A diaphragm pump comprising a pump body which defines internally at least one pair of pumping chambers which are connected, at an inlet, to at least one suction connector and, at an outlet, to at least one delivery connector of the pump, by means of the interposition of respective check valves, said at least one pair of pumping chambers being delimited by respective diaphragms separating said at least one pair of pumping chambers from respective actuation chambers, which is configured to be connected alternately to a source of compressed air by means of a power valve controlled by a pilot valve, provided with a sliding pad, which is pushed mechanically by said diaphragms and configured to move with a reciprocating motion within a pilot chamber, supplied with compressed air, in order to alternately connect said pilot chamber to a pilot port, connected to said power valve, or to a discharge port, connected to an outside environment, in said pump body there being an access opening adapted to allow access from outside to said pilot chamber and to said sliding pad, said access opening is configured to close by means of a closure element, wherein said closure element is configured to be removably fixed to said pump body, said closure element comprises a contact face which is configured to be inserted into said access opening and is designed to come into contact with said sliding pad, said pilot port and said discharge port being defined in said contact face, wherein said closure element comprises a main body made by molding and of plastic material and at least one plate-like element, which is coupled to said main body and defines at least one portion of said contact face, said at least one plate-like element being made of a material having, with respect to said sliding pad, a higher resistance to wear and a lower coefficient of friction than said plastic material.

2. The pump according to claim 1, wherein in said at least one plate-like element there are holes which respectively define said pilot port and said discharge port, said holes being arrangeable, with said at least one plate-like element coupled to said main body, in alignment, respectively, with a pilot channel and with a discharge channel, which are defined inside said main body, at least one gasket being interposed between said main body and said at least one plate-like element.

3. The pump according to claim 2, wherein said main body comprises a coupling portion, along an axis of extension of the main body, wherein, the coupling portion is shaped to correspond to said access opening and is inserted axially into said access opening at one end of the coupling portion, and a fixing head, which is arranged at an opposite end of said coupling portion and protrudes laterally with respect to said coupling portion to engage a region of the pump body arranged around said access opening, said fixing head having accommodation openings for fixing screws.

4. The pump according to claim 3, wherein a recessed region configured to receive said fixing head is defined in said pump body.

5. The pump according to claim 3, wherein said discharge channel is connected with the outside environment at least one exit opening, which is defined in a portion of the main body designed to be arranged externally to said pump body, said at least one exit opening-being located laterally with respect to said axis of extension of said main body.

6. The pump according to claim 5, wherein said discharge channel extends, starting from said discharge port toward said at least one exit opening, for at least one first section, substantially parallel to said axis of extension and, for at least one second section, connected with said at least one first section, substantially radially with respect to said at least one first section.

7. The pump according to claim 1, wherein an accommodation recess for said at least one plate-like element is defined in said main body.

8. The pump according to claim 1, wherein the material of which said at least one plate-like element is made is a metallic material or a ceramic material.

* * * * *